United States Patent [19]

Hewitt et al.

[11] 4,255,152

[45] Mar. 10, 1981

[54] PROCESS FOR THE DYEING OF HYDROPHOBIC FIBRES

[75] Inventors: Brian Hewitt, Holmes Chapel; Cyril Hobday, East Didsbury; James Jack, Bramhall; John F. E. Keenan, Cheadle Hulme, all of England

[73] Assignee: Ciba-Geigy Corporation, Ardsley, N.Y.

[21] Appl. No.: 939,583

[22] Filed: Sep. 5, 1978

Related U.S. Application Data

[63] Continuation of Ser. No. 762,070, Jan. 24, 1977, abandoned, which is a continuation of Ser. No. 543;197, Jan. 22, 1975, abandoned.

[51] Int. Cl.[3] ..... D06P 5/04

[52] U.S. Cl. ..... 8/583; 8/582; 8/610

[58] Field of Search ..... 8/169, 173, 582, 583, 8/610

[56] References Cited

U.S. PATENT DOCUMENTS

| | | | |
|---|---|---|---|
| 3,236,582 | 2/1966 | Hees | 8/173 |
| 3,313,590 | 4/1967 | Delano et al. | 8/93 |
| 3,617,211 | 11/1971 | Dawson | 8/173 |

FOREIGN PATENT DOCUMENTS

| | | |
|---|---|---|
| 1001966 | 2/1957 | Fed. Rep. of Germany . |
| 2256116 | 5/1973 | Fed. Rep. of Germany . |
| 2239930 | 6/1973 | Fed. Rep. of Germany . |
| 2162363 | 5/1976 | France . |
| 1021806 | 3/1966 | United Kingdom . |
| 1328107 | 12/1970 | United Kingdom . |
| 1372559 | 10/1974 | United Kingdom . |

*Primary Examiner*—A. Lionel Clingman

*Attorney, Agent, or Firm*—Prabodh I. Almaula; Edward McC. Roberts

[57] ABSTRACT

A batchwise process for dyeing hydrophobic fibres at 110° C. to 135° C. with a disperse dye in the presence of an adduct of an average of 1 to 4 molar proportions of ethylene oxide, propylene oxide or styrene oxide or a combination of these oxides with 1 molar proportion of a phenol compound having the formula

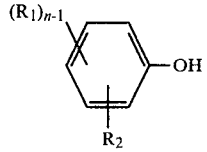

in which n is a number from 1 to 4, $R_1$ is hydrogen, chlorine an alkyl group with 1 to 8 carbon atoms, an alkoxy group with 1 to 8 carbon atoms or an alkenyl group with 2 to 8 carbon atoms.

$R_2$ is an alkyl group wtih 1 to 8 carbon atoms, an alkenyl group with 2 to 8 carbon atoms, a cyclo-alkyl group with 5 to 8 carbon atoms which is optionally substituted by one or more alkyl groups containing 1 to 4 carbon atoms, a cycloalkyl group with 5 to 8 carbon atoms, an aralkyl group containing 7 to 9 carbon atoms which is optionally substituted by an alkyl group with 1 to 4 carbon atoms in the aromatic ring, an aralkenyl group containing 2 or 3 carbon atoms in the alkenyl part, a hydroxymethyl or a $COOR_3$ group in which $R_3$ is phenyl optionally substituted by alkyl having 1 to 4 carbon atoms, aryloxyalkyl in which the alkyl part contains 2 or 3 carbon atoms and the aryl part is optionally substituted by one or more chlorine or one or more alkyl groups with 1 to 4 carbon atoms, or an aralkyl group with 7 to 9 carbon toms or a phenyl-hydroxyethyl group and with the proviso that (a) the total number of aliphatic carbon atoms in $(R_1)_{n-1} + R^2$ does not exceed 8

(b) the total number of aliphatic carbon atoms in $(R_1)_{n-1}$ when $R^2$ is alicyclic or aralkyl is 2, (c) when n is 1 and $R_2$ is alkyl, the alkyl group contains at least 2 carbon atoms and (d) when the adduct is derived from styrene oxide, $R_2$ can be hydrogen or chlorine, obtaining on said fibres level dyeings with an outstanding color yield.

24 Claims, No Drawings

PROCESS FOR THE DYEING OF HYDROPHOBIC FIBRES

This is a continuation of application Ser. No. 762,070 filed on Jan. 24, 1977, which is a continuation of application Ser. No. 543,197, filed Jan. 22, 1975 (now abandoned).

The present invention relates to the dyeing of hydrophobic fibres with disperse dyes.

It is well known to dye hydrophobic fibres in the presence of a dyeing assistant. These are usually water insoluble compounds applied in emulsion form.

In British Pat. No. 1,021,806, there is described a composition for the dyeing of hydrophobic materials, such as polyester fibres, comprising an acetate dyestuff, an aryl glycol ether of the general formula $$Ar(OCH_2CHR)_nOH$$

wherein R is hydrogen or methyl, Ar is an aromatic hydrocarbon radical of the benzene series optionally substituted by halogen or lower alkyl and n is 1 or 2, and a di- or trichlorobenzene. These dyeing compositions are, however, used at a temperature of 85° C. to the boiling temperature of the bath at atmospheric pressure, and especially at about 90° C.

In German Pat. No. 1,001,966 there is described a process for dyeing or printing polyester fibres with disperse dyes in the presence of oxyalkylethers of phenol or lower alkylated or monochloro derivatives thereof. This process is carried out in the presence of a surfaceactive agent at boiling temperatures.

In British Pat. No. 1,328,107 there is disclosed a process for dyeing polyester fibres using an aqueous dye liquor containing a disperse dye and a compound having the formula $$R{-}O{\leftarrow}CH_2CHXO{\rightarrow}_n{-}H$$

wherein R is a phenyl or chloro-substituted phenyl radical, n is an integer from 1 to 3 and X is hydrogen or methyl, being methyl when n is 1, and at least one X being methyl when n is 2 or 3 or a compound of formula $$R{-}O{\leftarrow}CH_2CH_2O{\rightarrow}_n{-}H$$

wherein R is a chloro-substituted phenyl grouping and n is an integer from 1 to 3, in the absence of a di- or trichlorobenzene or of an added emulsifier.

Further, in the Belgian Pat. No. 792 403 there is disclosed a process in which polyester is dyed using an aqueous dye liquor containing a disperse dye, an emulsifying agent and a compound or mixture of compounds having the formula:

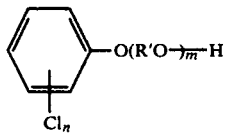

wherein n is an integer from 2 to 5, R' is an ethylene or isopropylene radical and m has an average value not greater than 3, in the absence of a di- or trichlorobenzene.

According to the present invention there is provided a batchwise process for dyeing hydrophobic fibres at 110° C. to 135° C. with a disperse dye in the presence of an adduct of an average of 1 to 4 molar proportions of ethylene oxide, propylene oxide or styrene oxide or a combination of these with 1 molar proportion of a phenol compound having the formula

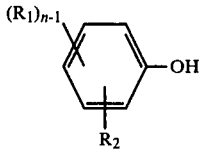

(1)

in which n is a number from 1 to 4, $R_1$ is hydrogen, chlorine, a straight or branched alkyl group with 1 to 8 carbon atoms, an alkoxy group with 1 to 8 carbon atoms, or an alkenyl group with 2 to 8 carbon atoms, $R_2$ is a straight or branched alkyl group with 1 to 8 cabon atoms, an alkenyl group with 2 to 8 carbon atoms, a cycloalkyl group with 5 to 8 carbon atoms which may optionally be substituted by one or more alkyl groups containing 1 to 4 carbon atoms, preferably one methyl group, a cycloalkenyl group with 5 to 8 carbon atoms, an aralkyl group containing 7 to 9 carbon atoms which may optionally be substituted by an alkyl group with 1 to 4 carbon atoms, an aralkenyl group containing 2 to 3 carbon atoms in the alkenyl part, a hydroxymethyl or a $COOR_3$ group in which $R_3$ is a phenyl optionally substituted by alkyl having 1 to 4 carbon atoms, aryloxyalkyl in which the alkyl part contains 2 or 3 carbon atoms and the aryl part may optionally be substituted by one or more chlorine or one or more straight or branched alkyl group with 1 to 4 carbon atoms or an aralkyl group with 7 to 9 carbon atoms or a phenylhydroxyethyl group, and such that, (a) the total number of aliphatic carbon atoms in $(R_1)_{n-1}+R^2$ does not exceed 8
(b) the total number of aliphatic carbon atoms in $(R_1)_{n-1}$ when $R^2$ is alicyclic or aralkyl is 2,
(c) when n is 1 and $R_2$ is alkyl, the alkyl group contains at least 2 carbon atoms and
(d) when the adduct is derived from styrene oxide, $R_2$ can be hydrogen or chlorine, obtaining on said fibres level dyeings with an outstanding colour yield.

The ratio of ehtylene oxide, propylene oxide, styrene oxide or combination of these is preferably an average of 1 molar proportion to 1 molar proportion of the phenol compound of formula (1). A preferred group of adducts is that derived from one unit of ethylene oxide.

When $R_1$ and/or $R_2$ are alkyl groups, they preferably contain from 1 to 4 carbon atoms and when $R_1$ is an alkoxy group it preferably contains from 1 to 4 carbon atoms when $R_1$ and/or $R_2$ are alkenyl groups they preferably contain 3 or 4 carbon atoms. Examples of $R_1$ are chloro, methyl, ethyl, isopropyl, t-butyl, sec-butyl, t-octyl, allyl, 2-butenyl and methoxy.

Examples of $R_2$ are methyl, ethyl, isopropyl, t-butyl, sec-butyl, heptyl, t-octyl, allyl, 2-butenyl, cyclopentyl, cyclohexyl, cyclooctyl, cyclopentenyl, cyclooctenyl, benzyl, α-methylbenzyl, α,α-dimethylbenzyl and $COOR_3$ groups in which $R_3$ is phenyl, isopropylphenyl, 2-phenoxyethyl, 1-phenoxy-2-propyl, benzyl and 2-phenyl-2-hydroxyethyl.

Particularly valuable adducts used as dyeing assistants according to the invention are these adducts or mixtures thereof which are listed under A and B.

A. Adducts of the formula

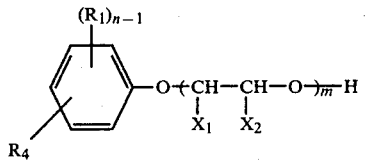

(2)

wherein $R_1$ and n have the meaning given for formula (1), $R_4$ represents a straight or branched alkyl group having at most 8 carbon atoms, an alkenyl group with 2 to 8 carbon atom, a cycloalkyl group with 5 to 8 carbon atoms which may contain one or two alkyl groups containing 1 to 4 carbon atoms, preferably one methyl group, a cycloalkenyl group with 5 to 8 carbon atoms, a phenylalkyl group having 1 to 3 carbon atoms in the alkyl part, optionally substituted by alkyl with 1 to 4 carbon atoms in the benzene nucleus, a phenylalkenyl group having 2 to 3 carbon atoms in the alkenyl part or a hydroxymethyl group, one of $X_1$ and $X_2$ is hydrogen, methyl or phenyl and the other is hydrogen and m is a number from 1 to 4, preferably 1, with the proviso that (a) the total number of carbon atoms in $(R_1)_{n-1}$, if present, is at most 8.

(b) when n is 1 and $R_4$ is alkyl, the alkyl group contains at least 2 carbon atoms and (c) when one of $X_1$ and $X_2$ represents phenyl, $R_4$ can also be hydrogen or chlorine.

Among these compounds of formula (2) one class of preferred compounds are those in which $R_1$ and $R_4$ are straight or branched alkyl with a total of 3 to 7 carbon atoms. Especially preferred compounds within this class are when n is 1 i.e. when only $R_4$ is present.

A second preferred group of compounds of formula (2) are those in which $R_1$ is hydrogen, methyl or chlorine, n is 2 and $R_4$ represents cyclopentyl, cyclohexyl, benzyl, α-methylbenzyl or α,α-dimethylbenzyl.

A third preferred group of compounds of formula (2) are those in which $R_1$ and $R_4$, independently of the other, are hydrogen or chlorine, one of $X_1$ and $X_2$ is phenyl and the other is hydrogen, is 1 or 2, preferably 1, and n is 2 to 4, preferably 2 or 3.

B. Salycilate adducts of the formula

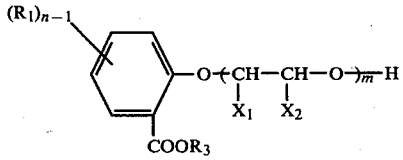

(3)

wherein $R_1$, $R_3$ and n have the meaning given for formula (1) and $X_1$ and $X_2$ and m have the meaning given for formula (2). Within the above formula (3) $R_3$ is preferably benzyl and most preferably phenyl, $R_1$ is hydrogen, one of $X_1$ and $X_2$ is hydrogen or methyl and the other is hydrogen and m is 1.

Examples of adducts as hereinbefore defined useful as dyeing assistants in the process of this invention are as follows:

2-(2-chloro-6-methylphenoxy)ethanol
1-(2-chloro-6-methylphenoxy)propan-2-ol
1-(4-chloro-3-methylphenoxy)propan-2-ol or ethanol
2-(2,4-dichloro-6-methylphenoxy)ethanol
2-(4-chloro-3,5-dimethylphenoxy)ethanol
1-(2,4-dichloro-6-methylphenoxy)propan-2-ol
2-(2,4-dichloro-3,5-dimethylphenoxy)ethanol
2-(2-isopropylphenoxy)ethanol
2-(o-ethyl-phenoxy)ethanol or 2-(p-ethyl-phenoxy)ethanol
2-(4-isopropylphenoxy)ethanol or 2-(heptyl-phenoxy)ethanol
2-(p-t-butylphenoxy)ethanol or 2-(p-octyl-phenoxy)ethanol
2-(2-chloro-4-t-butylphenoxy)ethanol
2-(2,3,5-trimethylphenoxy)ethanol
2-(2,6-di-isopropylphenoxy)ethanol
2-(2-t-butyl-6-methylphenoxy)ethanol
2-(2-allylphenoxy)ethanol
2-(2-methoxy-4-allylphenoxy)ethanol
2-(2-isopropyl-4-chloro-phenoxy)ethanol
2-(2,6-di-sec-butylphenoxy)ethanol
1-(o-benzyl-phenoxy)ethanol or 1-(p-benzylphenoxy)-propan-2-ol
1-(2-benzyl-4-chloro-phenoxy)-propan-2-ol
2-(o-α-methylbenzylphenoxy)ethanol
1-(p-α-methylbenzylphenoxy)propan-2-ol
1-(p-αα-dimethylbenzylphenoxy)propan-2-ol
2-(p-styryl-phenoxy)ethanol
2-(p-αα-dimethylbenzylphenoxy)ethanol
1-(2-isopropyl-4-αα-dimethylbenzylphenoxy)propan-2-ol
1-(2-benzyl-4-chloro-phenoxy)propan-2-ol
2-(2-isopropyl-4-αα-dimethylbenzylphenoxy)ethanol
2-(p-cyclopentylphenoxy)ethanol
2-(p-cyclohexylphenoxy)ethanol
2-(p-cyclooctylphenoxy)ethanol
1-(p-cyclohexylphenoxy)propan-2-ol
1-(p-2-cyclopentenylphenoxy)propan-2-ol
1-(2-isopropyl-4-cyclohexylphenoxy)propan-2-ol
1-(p-cyclopenten-2-yl-phenoxy)propan-2-ol
1-(o-isopropyl-p-cyclopenten-2-ylphenoxy)propan-2-ol
2-(p-1-methylcyclohexylphenoxy)ethanol
2-(o-hydroxymethylphenoxy)-1-phenylethanol
2-phenoxy-1-phenylethanol or 2-phenoxy-2-phenyl ethanol
diethyleneglycol mono-p-t-butyl-phenyl ether
diethyleneglycol mono-p-cyclohexyl-phenyl ether
a condensation product of 1 molar proportion of 4-chloro-m-cresol and 4 molar proportion of propylene oxide.
a condensation product of 1 molar proportion of 4-chloro-3,5-xylenol and 3 molar proportions of ethylene oxide
phenyl-o-(2-hydroxyethoxy)benzoate
phenyl-o-(2-hydroxypropoxy)benzoate
benzyl 2-(2-hydroxyethoxy)benzoate
benzyl 2-(2-hydroxyethoxy)-6-methylbenzoate
2-isopropylphenyl 2-(2-hydroxy-propoxy)benzoate
2-phenoxyethyl 2-(2-hydroxy-1-propoxy)benzoate
2-hydroxy-2-phenylethyl 2-(2-hydroxy-1-propoxy)benzoate
1-(2,4-dichlorophenoxy)prop-2-yl 2-(2-hydroxyprop-1-oxy) benzoate
2-(o-isopropylphenoxy)ethyl 2-(2-hydroxyprop-1-oxy)-benzoate
1-phenyl-2-hydroxyethyl benzoate or
2-phenyl-2-hydroxyethyl benzoate.

Adducts of formula (1) which contain no chlorine are preferred on ecological grounds.

The hydrophobic fibre may be for instance a cellulose triacetate fibre but this invention is particularly applicable to linear polyester fibres, especially to fibres of polyethylene glycol terephthalate.

The disperse dye that is used may be for example an azo, anthraquinone, nitro, methine, styrene, azostyrene, nitroacridone, coumarine, naphthoperinone, quinaphthalone or naphthoquinone imine dyestuff.

The amount of dye that is used in the dye liquor will depend upon the circumstances and may be an amount up to 10% by weight based on the weight of fibre to be dyed.

The adducts as hereinbefore defined may be used in several ways. For instance, they may be used alone or they may be mixed with an emulsifying agent, such as sulphated alkylphenol ethylene oxide adduct, and optionally an organic solvent such as isopropanol, to give a homogeneous, self-emulsifiable product which may be added to the dyebath.

Where the adducts hereinbefore defined have low solubility in water and are used in dyeing machines where surface active agents of the above type are used, there is a tendency for excessive foam to be developed. Under these circumstances the adducts can be formulated with low foaming surface active agents derived from synthetic or natural origin, for example, sulphited fish oils.

The process according to the present invention is carried out batchwise and the adduct as hereinbefore defined may be added directly to a dyebath. The temperature at which the dyeing is carried out, is normally from 110° C. to 135° C. according to a so-called high temperature dyeing process, especially from 115° C. to 135° C. The duration of the dyeing will depend on the circumstances but generally a period of up to 2 hours will suffice.

The amount of the adduct, as hereinbefore defined, may be within the range of from 0.5% to 2% and preferably from 0.1% to 1%, by volume based on the total volume of the aqueous dye liquor.

The dyeing may, if desired, be completed by transferring the fibre to a separate bath where it undergoes a reduction clearing process to remove the surface dye. The fibre may afterwards be rinsed and dried.

The dyeing process is suitable for use with loose stock, yarn, woven/knitted fabrics and carpets.

In addition to fibres made entirely of a single hydrophobic fibre such as polyester or cellulose triacetate, the dyeing process of the present invention may be carried out on blends of textile fibres such as blends containing polyester together with other fibres such as wool, cotton, acrylic, cellulosic or polyamide fibres.

The dyeing process of the present invention is especially valuable when used in modern high temperature dyeing machines such as the Jet, Winch or Package dyeing machines, and it is then found that the resulting dyed material has better levelling properties, a higher colour yield than by using for example monochlorophenoxy ethanols and cresoxy ethanols.

Some Examples will now be given, parts being expressed by weight unless otherwise stated. Parts by weight bear the same relation to parts by volume as do kilograms to liters.

EXAMPLE 1

4 Parts of a polyethylene terephthalate (Crimplene) fabric are immersed in 160 parts by volume of an aqueous dye liquor containing:

(a) 0.12 parts of the dyestuff which is a mixture of

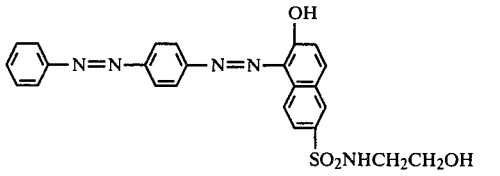

and

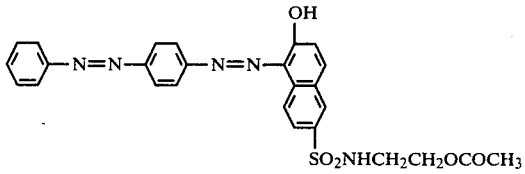

in a ratio 1:1 and (b) 0.32 parts of 2-(2-chloro-6-methyl-phenoxy)ethanol.

The pH is adjusted to 5–6 with acetic acid, and the dyeing is carried out at a temperature of 120° C. for one hour.

The fabric is then transferred to a separate bath containing 160 parts of an aqueous liquor containing 0.8 parts of sodium hydroxide solution 70° Tw, 0.32 parts of sodium dithionite and B 0.32 parts of an ethylene oxide condensate of stearyldiethylenetriamine at 70° C. for 30 minutes. The fabric is afterwards rinsed in warm water and dried. A level red dyeing is obtained with good colour yield.

EXAMPLE 2

4 Parts of a polyethylene terephthalate (Crimplene) fabric are immersed in 160 parts by volume of an aqueous dye liquor containing:

(a) 0.12 parts of the dyestuff which is a mixture of

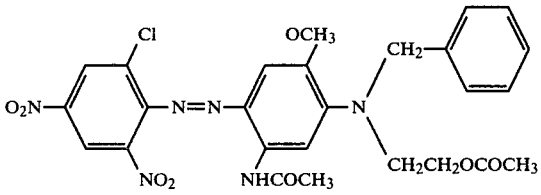

and

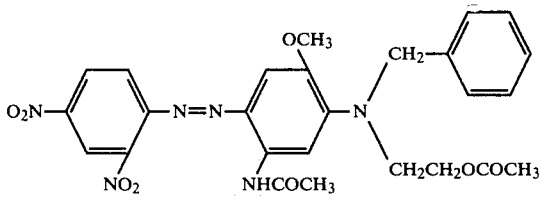

in a ratio 3:1.

(b) 0.32 parts of 1-(2-chloro-6-methyl-phenoxy)propan-2-ol

The pH is adjusted to 5–6 with acetic acid and the dyeing is carried out at a temperature of 120° C. for one hour.

The fabric is then transferred to a separate bath containing 160 parts of an aqueous liquor containing 0.8 parts of sodium hydroxide solution 70° Tw, 0.32 parts of sodium dithionite and 0.32 parts of an ethylene oxide condensate of stearyldiethylenetriamine at 70° C. for 30 minutes. The fabric is afterwards rinsed in warm water and dried. A level navyblue dyeing is obtained with good colour yield.

EXAMPLE 3

By following a similar procedure to that described in Example 1 but using 0.32 parts of 1-(2,4-dichloro-6-methyl-phenoxy)propan-2-ol instead of component (b), a level dyeing is obtained with good colour yield.

EXAMPLE 4

By following a similar procedure to that described in Example 1 but using 0.32 parts of 1-(4-chloro-3-methyl-phenoxy)propan-2-ol instead of component (b), a level dyeing is obtained with good colour yield.

EXAMPLE 5

By following a procedure similar to that described in Example 1 but using 0.50 parts of the below self emulsifiable oil instead of component (b), a level dyeing is obtained with good colour yield. The self emulsifiable oil used as dyeing assistant in this Example is prepared as follows:

In a flask fitted with a stirrer, thermometer, reflux condenser connected to a cold trap, and a gas inlet, is placed 156.6 parts of 4-chloro-3,5-xylenol and 1 part of finely powdered sodium hydroxide. The apparatus is initially purged with nitrogen and a very slow stream of nitrogen is maintained throughout the ethoxylation.

With the temperature maintained at 140° to 160° C., 130.3 parts of ethylene oxide is added gradually to the stirred mixture over a period of 105 minutes, and the reaction mass is then allowed to cool. It is dissolved in 1250 parts by volume of diisopropyl ether, and is washed until neutral in a separating funnel with water (5×100 parts by volume). The solution is then dried over and filtered. The solvent is then distilled off.

A self emulsifiable oil is prepared by mixing 69 parts of the above adduct, 13 parts of isopropanol and 13.5 parts of the sodium sulphate ester of a commercial nonyl phenol/ethylene oxide adduct in 4.5 parts of aqueous ethanol.

EXAMPLE 6

By following a procedure similar to that described in Example 1 but using instead of component (b), 0.64 parts of a self emulsifiable oil prepared by mixing 40 parts of 2-(2,4-dichloro-6-methyl-phenoxy)ethanol, 28 parts of isopropanol, and 9 parts of the sodium sulphate ester of the commercialnonyl phenol/ethylene oxide adduct in 3 parts of aqueous ethanol, a level dyeing is obtained with good colour yield.

EXAMPLE 7

By following a procedure similar to that described in Example 1 but using instead of component (b) 0.64 parts of a self emulsifiable oil prepared by mixing 40 parts of 2-(4-chloro-3,5-dimethylphenoxy)ethanol, 28 parts of isopropanol, and 9 parts of the sodium sulphate ester of the commercial non phenol/ethylene oxide adduct in 3 parts of aqueous ethanol, a level dyeing is obtained with good levelling colour yield.

EXAMPLE 8

By following a procedure similar to that described in Example 1 but using 0.64 parts of the below self emulsifiable oil, a level dyeing is obtained with outstanding colour yield. The self emulsifiable oil used in this Example is prepared as follows:

In a flask fitted with a stirrer, thermometer, reflux condenser connected to a cold trap, and a gas inlet, is placed 191 parts of 2,4-dichloro-3,5-xylenol and 1 part of finely powdered sodium hydroxide. The apparatus is initially purged with nitrogen and a very slow stream of nitrogen is maintained throughout the ethoxylation.

With the temperature maintained at 140° C., 44.4 parts of ethylene oxide is added gradually to the stirred mixture over a period of 115 minutes, before it is allowed to cool.

The solid product is recrystallised twice from di-n-butyl ether yielding 119.2 parts of 2-(2,4-dichloro-3,5-dimethylphenoxy)ethanol, m.p. 99°–100° C.

Analysis: C=51.01%; H=5.12%; Cl=30.36%. Calculated; C=51.00%; H=5.15%; Cl=30.16%.

A self emulsifiable oil is prepared by mixing 20 parts of 2-(2,4-dichloro-3,5-dimethylphenoxy)ethanol, 54 parts of isopropanol and 4.5 parts of a sodium sulphate ester of a commercial nonylphenol/ethylene oxide adduct in 1.5 parts of aqueous ethanol.

EXAMPLE 9

By following a similar procedure to that described in Example 1 but using 0.5 parts of a self emusifiable oil prepared by mixing 69 parts of 2-(2-chloro-4-t-butyl-phenoxy)ethanol, 13 parts of isopropanol and 13.5 parts of a sodium sulphate ester of a commercial nonyl-phenol/ethylene oxide adduct in 4.5 parts of aqueous ethanol, a level dyeing is obtained with outstanding colour yield.

EXAMPLE 10

By following a procedure similar to that described in Example 1 but using instead of component (b) 0.25 parts of the below self emulsifiable oil, a level dyeing is obtained with outstanding colour yield.

The emulsifiable oil used as dyeing assistant in this Example is prepared as follow:

In a flask fitted with a stirrer, thermometer, reflux condenser connected to a cold trap, a gas inlet, and dropping funnel, is placed 3 parts of finely powdered sodium hydroxide and 378 parts of a mixture of phenols of the following constitutions:

| | |
|---|---|
| Phenol | 30.8% |
| o-isopropylphenol | 34.6% |
| m/p-isopropylphenol | 12.3% |
| 2,6-di-isopropylphenol | 6.4% |
| 2,4-diisopropylphenol | 10.7% |
| 2,5/3,5-diisopropylphenol | 2.5% |
| 2,4,6-triisopropylphenol | 2.5% |
| 2,4,5-triisopropylphenol | 0.2% |

The apparatus is initially purged with nitrogen and a very slow stream of nitrogen is maintained throughout the propoxylation.

With the temperature maintained at 140° C. 188.8 parts of propylene oxide is added over a period of 320 minutes, and the reaction is then allowed to cool.

The reaction mass is then washed with 10×20 parts by volume of saturated salt solution, and dried at 12 mm, pressure, yielding 542.9 parts of the adduct.

A self emulsifiable oil is prepared by mixing 85 parts of the above adduct, and 11.2 parts of a sodium sulphate ester of a commercial nonylphenol/ethylene oxide adduct in 3.8 parts of aqueous ethanol.

EXAMPLE 11

By following a procedure similar to that described in Example 1 but using instead of component (b), 0.25 parts of a self emulsifiable oil prepared by mixing 85 parts of 2-(o-iso-propylphenoxy)ethanol and 11.2 parts of a sodium sulphate ester of a commercial nonylphenol/ethylene oxide adduct in 3.8 parts of aqueous ethanol, a level dyeing is obtained with outstanding colour yield.

EXAMPLE 12

By following a procedure similar to that described in Example 1 but using 0.25 parts of the below self emulsifiable oil instead of component (b), a level dyeing is obtained with outstanding colour yield. The selt emulsifiable oil used in this Example is prepared as follows:

In a flask fitted with a stirrer, thermometer, reflux condenser connected to a cold trap, and a gas inlet, is placed 68 parts of 4-isopropylphenol and 0.5 parts of finely powdered sodium hydroxide. The apparatus is initially purged with nitrogen and a very slow stream of nitrogen is maintained throughout the ethoxylation.

With the temperature maintained at 140° C. 25.2 parts of ethylene oxide is added to the stirred mixture over a period of 37 minutes. The reaction mixture is washed with 10×10 parts by volume of water dried at 12 mm pressure yielding 88.2 parts of 2-(4-isopropylphenoxy) ethanol.

A self emulsifiable oil is prepared by mixing 85 parts of 2-(4-isopropylphenoxy)ethanol, and 11.3 parts of a sodium sulphate ester of a commercial nonylphenol-/ethylene oxide adduct in 3.7 parts of aqueous ethanol.

EXAMPLE 13

By following a procedure similar to that described in Example 1 but using 0.32 parts of a product derived from the addition of one molecule of ethylene oxide to a mixture of commercial xylenols instead of component (b), a level dyeing is obtained with good colour yield.

EXAMPLE 14

By following a procedure similar to that described in Example 1 but using 0.50 parts of the below self emulsifiable oil instead of component (b), a level dyeing is obtained outstanding colour yield. The selt emulsifiable oil used in this Example is obtained as follow:

The phenol mixture described in Example 10 is ethoxylated with ethylene oxide according to the method described in Example 12.

A self emulsifiable oil is prepared by mixing 85 parts of the product obtained above, and 11.3 parts of the sodium sulphate ester of a commercial nonylphenol-/ethylene oxide adduct in 37 parts of aqueous ethanol.

EXAMPLE 15

By following a procedure similar to that described in Example 1 but using instead of component (b), 1.3 parts of the self emulsifiable oil, prepared by mixing 25 parts of 2-(2,3,5-trimethylphenoxy)ethanol, 67.5 parts of isopropanol and 5.7 parts of the sodium sulphate ester of a commercial nonylphenol/ethylene oxide adduct in 1.9 parts of aqueous ethanol, a level dyeing is obtained with outstanding colour yield.

EXAMPLE 16

By following a procedure similar to that described in Example 1 but using 0.4 parts of the below self emulsifiable oil instead of component (b), a level dyeing with outstanding colour yield is obtained which is superior to that obtained from using a self emulsifiable oil made up from 69 parts of 2,4-dichlorophenoxypropanol alone as active ingredient. The dyeing assistant mixture used in this Example is prepared as follows:

In a flask fitted with a stirrer, thermometer, reflux condenser connected to a cold trap, and a gas inlet, is placed 107 parts of phenyl salicylate and 1.6 parts triethylamine. The apparatus is initially purged with nitrogen and a very slow stream of nitrogen is maintained throughout the ethoxylation.

With the temperature maintained at 165° C., 30 parts of ethylene oxide is added gradually over a period of 150 minutes. The product is distilled and a solid distillate of 56 parts is collected b.p. 170°-210° C./0,3 mm. The phenyl o-(2-hydroxyethoxy)benzoate is recrystallised from isopropanol m.p. 61°-63° C.

Analysis. C=69.81%; H=5.58%. Calculated: C=69,76%; H=5.46%.

A self emulsifiable oil is prepared by mixing 34.5 parts of phenyl o-(2-hydroxyethoxy)benzoate, 34.5 parts of 2,4-dichlorophenoxypropanol, 13 parts of isopropanol, and 13.5 parts of the sodium sulphate ester of a commercial nonylphenol/ethylene oxide adduct in 4.5 parts of aqueous ethanol.

EXAMPLE 17

By following a procedure similar to that described in Example 1 but using instead of component (b) 0,4 parts of a self emulsifiable oil prepared by mixing 69 parts of 2-(p-t-butylphenoxy)ethanol, 13 parts of isopropanol and 13.5 parts of the sodium sulphate ester of a commercial nonylphenol/ethylene oxide adduct in 4.5 parts of aqueous ethanol, a level dyeing is obtained with outstanding colour yield.

EXAMPLE 18

By following a procedure similar to that described in Example 1 but using instead of component (b), 0.4 parts of a self emulsifiable oil prepared by mixing 72 parts of 2-(2,6-diisopropylphenoxy)ethanol and 21 parts of the sodium sulphate ester of a commercial nonylphenol-/ethylene oxide adduct in 7 parts of aqueous ethanol, a level dyeing is obtained with an outstanding colour yield.

EXAMPLE 19

By following a procedure similar to that described in Example 1 but using instead of component (b), 0.6 parts of a self emulsifiable oil prepared by mixing 50 parts of diethylene glycol mono-p-t-butylphenyl ether with 30 parts of isopropanol and 15 parts of the sodium sulphate ester of a commercial nonylphenol/ethylene oxide adduct in 5 parts of aqueous ethanol, a level dyeing is obtained with outstanding colour yield.

EXAMPLE 20

By following a procedure similar to that described in Example 1 but using instead of component (b), 0.4 parts of a self emulsifiable oil prepared by mixing 69 parts of 2-(2-t-butyl-6-methylphenoxy)ethanol, 13 parts of isopropanol and 13.5 parts of the sodium sulphate ester of a commercial nonylphenol/ethylene oxide adduct in 4.5 part of aqueous ethanol, a level dyeing is obtained with outstanding colour yield.

EXAMPLE 21

By following a procedure similar to that described in Example 1 but using instead of component (b) 0.4 parts of a self-emulsifiable oil prepared by mixing 69 parts of 2-(o-ethylphenoxy)ethanol, 13 parts isopropanol and 13.5 parts of the sodium sulphate ester of a commercial nonylphenol/ethylene oxide adduct in 4.5 parts of aqueous ethanol, a level dyeing is obtained with outstanding colour yield.

EXAMPLE 22

By following a procedure similar to that described in Example 1 but using 0.4 parts of the below self emulsifiable oil instead of component (b), a level dyeing is obtained with outstanding colour yield. The self emulsifiable oil used in this example is prepared as follows:

In a flask fitted with a stirrer, thermometer, reflux, condenser connected to a cold trap and a gas inlet, is placed 106 parts p-αα-dimethylbenzylphenol and 1.6 parts triethylamine. The apparatus is initially purged with nitrogen and a very slow stream of nitrogen is maintained throughout the ethoxylation. With the temperature maintained at 170° C. 21.8 parts of ethylene oxide gas is added gradually over a period of 40 minutes. The reaction mixture after cooling is dissolved in diisopropyl ether and a little solid material filtered off. The solution is washed with water and dried over magnesium sulphate, the diisopropyl ether is distilled, followed by the 2-(p-α,α-dimethylbenzylphenoxy) ethanol collected at 160°-170° C./1.8 mm. (96.6 g.) The solid product is recrystallized from petroleum ether (b.p. 40°-60° C.) m.p. 42° to 43.5° C.

Analysis. C=79.76%; H=7.62%. Calculated: C=79.65%; H=7.86%.

A self emulsifiable oil is prepared by mixing 69 parts of 2-(p-α,α-dimethylbenzylphenoxy)ethanol, 13 parts of isopropanol and 13.5 parts of the sodium sulphate ester of a commercial nonylphenol/ethylene oxide adduct in 4.5 parts of aqueous ethanol.

EXAMPLE 23

By following a procedure similar to that described Example 1 but using 0.4 parts of the below self emulsifiable oil instead of component (b), a level dyeing is obtained with good colour yield. The self emulsifiable oil used in this example is prepared as follows:

In a flask fitted with a stirrer, thermometer, reflux condenser connected to a cold trap, and gas inlet, is placed 71 parts of 4-chloro-m-cresol and 0.5 parts powdered sodium hydroxide. The apparatus is initially purged with nitrogen and a very slow stream of nitrogen is maintained throughout the propoxylation.

With the temperature maintained at 140° C. 124.2 parts of propylene oxide is added gradually over 19 hours.

After cooling the product is dissolved in diisopropylether, washed with water until neutral, dried over magnesium sulphate. The solvent is distilled off, leaving 172 parts of product shown by NMR spectroscopy to contain an average of 4 moles of propylene oxide per mole of 4-chloro-m-cresol. A self emulsifiable oil is prepared by mixing 72 parts of the above adduct and 21 parts of a sodium sulphate ester of a commercial nonylphenol/ethylene oxide adduct in 7 parts of aqueous ethanol.

EXAMPLE 24

By following a procedure similar to that described in Example 1 but using instead of component (b), 0.48 parts of a self emulsifiable oil prepared by mixing 69 parts of 1-(p-α,α-dimethylbenzylphenoxy)propan-2-ol, 13 parts of isopropanol and 13.5 parts of the sodium sulphate ester of a commercial nonylphenol/ethylene oxide adduct in 4.5 parts of aqueous ethanol, a level dyeing is obtained with an outstanding colour yield.

EXAMPLE 25

By following a procedure similar to that described in Example 1 but using 0.48 parts of the below self emulsifiable oil instead of component (b), a level dyeing is obtained with an outstanding colour yield. The self emulsifiable oil used in this example is prepared as follows:

In a flask fitted with a stirrer, dropping funnel, thermometer, reflux condenser connected to a cold trap, and a gas inlet, is placed 107 parts of phenyl salicylate and 2 parts of triethylamine. The apparatus is initially purged with nitrogen and a very slow stream of nitrogen is maintained throughout the propoxylation.

With the temperature maintained at 160° C.-165° C. 30 g. of propylene oxide is added dropwise over a period of 11 hours. The product is distilled and 76 parts of phenyl o-(hydroxypropoxy) benzoate is collected b.p. 140°-150° C./0.4 mm.

Analysis. C=70.62; H=6.06. Calculated: C=70.58; H=5.92.

A self emulsifiable oil is prepared by mixing 75 parts of phenyl o-(hydroxypropoxy)benzoate and 19 parts of the sodium sulphate ester of a commercial nonylphenol/ethylene oxide adduct in 6 parts of aqueous ethanol.

EXAMPLE 26

By following a procedure similar to that described in Example 1 but using instead of component (b), 0.4 parts of the self emulsifiable oil prepared by mixing 75 parts of 2-(p-cyclohexylphenoxy)ethanol and 19 parts of the sodium sulphate ester of a commercial nonylphenol/ethylene oxide adduct in 6 parts of aqueous ethanol, a level dyeing is obtained with an outstanding colour yield.

EXAMPLE 27

By following a procedure similar to that described in Example 1 but using 0.48 parts of the below self emulsifiable oil instead of component (b), a level dyeing is obtained with an outstanding colour yield. The self emulsifiable oil used in this example is prepared as follows:

In a flask fitted with a stirrer, thermometer, reflux condenser connected to a cold trap, and a gas inlet, is placed 88 parts of p-cyclohexylphenol and 0.5 part powdered sodium hydroxide. The apparatus is initially purged with nitrogen and a very slow stream of nitrogen is maintained throughout the ethoxylation.

With the temperature maintained at 180° C., 52 parts of ethylene oxide was added gradually over a period of 50 minutes. The product is dissolved in chloroform and the alkali is washed out with water. After drying the solution is distilled. The diethylene glycol mono-p-cyclohexylphenyl ether is distillted 170°-180°/0.01 mm to give a yield of 100.8 parts.

A self emulsifiable oil is prepared by mixing 75 parts of diethylene glycol mono-p-cyclohexylphenyl ether and 19 parts of the sodium sulphate ester of a commercial nonylphenol/ethylene oxide adduct in 6 parts of aqueous ethanol.

EXAMPLE 28

By following a procedure similar to that described in Example 1 but using instead of component (b), 0.48 parts of a self emulsifiable oil prepared by mixing 69 parts of mixed 2-(styrylphenoxy)ethanols, 13 parts of isopropanol and 13.5 parts of the sodium sulphate ester of a commercial nonylphenol/ethylene oxide adduct in 4.5 parts of aqueous ethanol, a level dyeing is obtained with an outstanding colour yield.

EXAMPLE 29

By following a similar procedure to that described in Example 1 but using 0.4 part of the below self emulsifiable oil instead of component (b), a level dyeing is obtained with an outstanding colour yield. The self emulsifiable oil used in this example is prepared as follows:

o-(2-Hydroxyethoxy)benzoic acid lactone (10 parts) and 0.1 part lithium amide are refluxed in benzyl alcohol (50 mls) for 10 hours. The benzyl-alcohol is then distilled under vacuum. Chloroform is added and the lithium amide filtered at the pump. The product is distilled and the benzyl o-(2-hydroxyethoxy)benzoate is collected at 150°-200° C./0.2 mm (10.8 parts).

Analysis. C=70.38%; H=5.90%. Calculated: C=70.58%; H=5.92%

A self emulsifiable oil is prepared by mixing 25 parts of benzyl o-(2-hydroxyethoxy)benzoate, 60 parts of isopropanol, 11.2 parts of the sodium sulphate ester of a commercial nonyl phenol/ethylene oxide adduct in 3.8 parts of aqueous ethanol.

EXAMPLE 30

By following a procedure similar to that described in Example 1 but using instead of component (b), 0.4 parts of a self emulsifiable oil prepared by mixing 69 parts of monoethoxylated commercial benzyl-cresol, 13 parts of isopropanol and 13.5 parts of the sodium sulphate ester of a commercial nonylphenol/ethylene oxide adduct in 4.5 parts of aqueous ethanol, a level dyeing is obtained with outstanding colour yield.

EXAMPLE 31

By following a procedure similar to that described in Example 1 but using 0.4 part of the below self emulsifiable oil instead of component (b), a level dyeing is obtained with good colour yield. The self emulsifiable oil used in this example is prepared as follows:

p-Ethylphenol (854 parts) is ethoxylated with ethylene oxide (348 parts) using sodium hydroxide (7 parts) as catalyst at 145° C. in a method similar to that used in Example 12 to give 2-(p-ethylphenoxy)ethanol m.p. 48°-49° C. (987 parts).

Analysis. C=72.26%; H=8.57%. Calculated: C=72.26%; H=8.49%.

A self emulsifiable oil is prepared by mixing 69 parts of 2-(p-ethylphenoxy)ethanol, 13 parts of isopropanol and 13.5 parts of the sodium sulphate ester of a commercial nonylphenol/ethylene oxide adduct in 4.5 parts of aqueous ethanol.

EXAMPLE 32

By following a procedure similar to that described in Example 1 but using 0.6 part of the above self emulsifiable oil instead of component (b) a level dyeing is obtained with outstanding colour yield. The self emulsifiable oil used in this example is prepared as follows:

2-Benzyl-4-chlorophenol (43.7 parts) is propoxylated with propylene oxide (12.6 parts) using sodium hydroxide (0.2 part) as catalyst at 145° C. in a manner similar to that used in Example 10 to give 1-(2-benzyl-4-chlorophenoxy)propan-2-ol (16.3 parts)

A self emulsifiable oil is prepared by mixing 50 parts of 1-(2-benzyl-4-chlorophenoxy)propan-2-ol, 35 parts of isopropanol and 11.25 parts of the sodium sulphate ester of a commercial nonylphenol/ethylene oxide adduct in 3.75 parts of aqueous ethanol.

EXAMPLE 33

By following a procedure similar to that described in Example 1 but using instead of component (b) 0.4 part of the self emulsifiable oil prepared by mixing 75 parts of 2-(cyclopentyl-phenoxy)ethanol and 19 parts of the sodium sulphate ester of a commercial nonylphenol-/ethylene oxide adduct in 6 parts of aqueous ethanol, a level dyeing is obtained with outstanding colour yield.

EXAMPLE 34

By following a procedure similar to that described in Example 1 but using 0.4 part of the below self emulsifiable oil instead of component (b), a level dyeing is obtained with excellent colour yield. The self emulsifiable oil used in this example is prepared as follows;

o-Benzylphenol (36.8 parts) is ethoxylated with ethylene oxide (8.9 parts) using sodium hydroxide (0.2 part) as catalyst at 120° C. in a method similar to that used in Example 12 to give 2-(o-benzylphenoxy)ethanol (28.6 parts).

Analysis. C=78.90%; H=7.23%. Calculated: C=78.92%; H=7.06%.

A self emulsifiable oil is prepared by mixing 69 parts of 2-(o-benzylphenoxy) ethanol, 13 parts of isopropanol and 13.5 parts of the sodium sulphate ester of a commercial nonylphenol/ethylene oxide adduct in 4.5 parts of aqueous ethanol.

EXAMPLE 35

By following procedure similar to that described in Example 1 but using instead of component (b) 0.4 part of a self emulsifiable oil prepared by mixing 75 parts of 2-(o-α-methylbenzylphenoxy)ethanol and 19 parts of the sodium sulphate ester of a commercial nonylphenol-/ethylene oxide adduct in 6 parts of aqueous ethanol, a level dyeing was obtained with outstanding colour yield.

EXAMPLE 36

By following a procedure similar to that described in Example 1 but using instead of component (b) 0.4 part of a self emulsifiable oil prepared by mixing 69 parts of 2-(o-allylphenoxy)ethanol, 13 parts of isopropanol and 13.5 parts of the sodium sulphate ester of a commercial nonylphenol/ethylene oxide adduct in 4.5 parts of aqueous ethanol, a level dyeing is obtained with good colour yield.

EXAMPLE 37

By following a procedure similar to that described in Example 1 but using 0.4 parts of the below self emulsifiable oil instead of component (b), a level dyeing is obtained with excellent colour yield. The self emulsifiable oil used in this example is prepared as follows:

A mixture of cyclooctylphenols (59.0 parts) is ethoxylated with ethylene oxide (13.7 parts) using sodium hydroxide as catalyst (0.3 part) at 145° C. in a method similar to that used in Example 12 to give a mixture of 2-(cyclooctylphenoxy)ethanols b.p. 125°–150° C./0.8 mm. (17.3 parts).

A self emulsifiable oil is prepared by mixing 69 parts of 2-(cyclooctylphenoxy)ethanols, 13 parts of isopropanol and 13.5 parts of the sodium sulphate ester of a commercial nonylphenol/ethylene oxide adduct in 4.5 parts of aqueous ethanol.

EXAMPLE 38

By following a procedure similar to that described in Example 1 but using instead of component (b) 0.4 parts of a self emulsifiable oil prepared by mixing 69 parts of 2-(p-1-methylcyclohexylphenoxy)ethanol, 13 parts of isopropanol and 13.5 parts of the sodium sulphate ester of a commercial nonylphenol/ethylene oxide adduct in 4.5 parts of aqueous ethanol, a level dyeing is obtained with very good colour yield.

EXAMPLE 39

By following a procedure similar to that described in Example 1 but using 0.4 parts of the below self emulsifiable oil instead of component (b), a level dyeing is obtained with a very good colour yield. The self emulsifiable oil used in this example is prepared as follows:

The mixture of phenols described in Example 10 (63.8 parts) is heated at 140° C. with styrene oxide (60.0 parts) containing sodium hydroxide (0.4 part) as catalyst for 3 hours. After dissolving the product in diisopropyl ether, the solution is washed until neutral. The product was distilled to give 65 parts of the styrene oxide adduct b.p. 120°–180° C./0.3 mm.

A self emulsifiable oil is prepared by mixing 69 parts of this styrene oxide adduct, 13 parts of isopropanol and 13.5 parts of the sodium sulphate ester of a commercial nonylphenol/ethylene oxide adduct in 4.5 parts of aqueous ethanol.

EXAMPLE 40

By following a similar procedure to that described in Example 1 but using instead of component (b) 0.4 parts of a self emulsifiable oil prepared by mixing 85 parts of 2-(2-isopropyl-4-chlorophenoxy)ethanol and 11.2 parts of the sodium sulphate ester of a commercial nonylphenol/ethylene oxide adduct in 3.8 parts of aqueous ethanol, a level dyeing is obtained with very good colour yield.

EXAMPLE 41

By following a similar procedure to that described in Example 1 but using 0.3 parts of 2-(4-allyl-2-methoxyphenoxy)ethanol of component (b), a level dyeing is obtained with very good colour yield.

EXAMPLE 42

By following a procedure similar to that described in Example 1 but using 0.6 part of the below self emulsifiable oil instead of component (b), a level dyeing is obtained with outstanding colour yield. The self emulsifiable oil used in this example is prepared as follows:

2,6-di-sec-butylphenol (103 parts) is ethoxylated with ethylene oxide (29 parts) using sodium hydroxide (0.5 part) as catalyst at 150° C. in a method similar to that used in Example 12 to give 2-(2,6-di-sec-butylphenoxy)-ethanol (70 parts) b.p. 132°–136° C./0.9 mm.

Analysis. C=76.65%; H=10.24%. Calculated; C=76.75%; H=10.47%.

A self emulsifiable oil is prepared by mixing 50 parts 2-(2,6-di-sec-butylphenoxy)ethanol, 13 parts of isopropanol and 11.25 parts of the sodium sulphate ester of a commercial nonylphenol/ethylene oxide adduct in 3.75 parts of aqueous ethanol.

EXAMPLE 43

By following a procedure similar to that in Example 1 but using instead of component (b) 0.4 parts of a self emulsifiable oil prepared by mixing 69 parts 2-(p-octylphenoxy)ethanol, 13 parts isopropanol and 13.5 parts of the sodium sulphate ester of a commercial nonylphenol-/ethylene oxide adduct in 4.5 parts of aqueous ethanol, a level dyeing is obtained with good colour yield.

EXAMPLE 44

By following a procedure similar to that described in Example 1 but using instead of component (b), 0.6 parts of a self emulsifiable oil prepared by mixing 50 parts of 2-(heptyl-phenoxy)ethanol, 35 parts of isopropanol and 11.25 parts of the sodium sulphate ester of a commercial nonylphenol/ethylene oxide adduct in 3.75 parts of aqueous ethanol, a level dyeing is obtained with very good colour yield.

COMPARATIVE EXAMPLES

When the active ingredients of component (b) in the foregoing examples are replaced by the same quantities of the following chemicals:

2-phenoxyethanol, 2-cresoxy-ethanols, p-cresoxypropan-2-ol, monochlorophenoxyethanols and 3-phenylpropanol, the colour yields are inferior.

We claim:

1. A batchwide process for dyeing polyester fibres at 110° C. to 135° C. with a disperse dye in the presence of an adduct in aqueous medium, said adduct being in an amount from 0.05% to 2% by volume based on the total volume of the medium and having an average of 1 to 4 molar proportions of ethylene oxide, propylene oxide or styrene oxide or a combination of these oxides with 1 molar proportion of a phenol compound having the formula

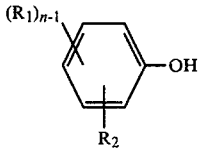

(1)

in which n is a number from 1 to 4, $R_1$ is hydrogen, chlorine, an alkyl group with 1 to 8 carbon atoms, an alkoxy group with 1 to 8 carbon atoms or an alkenyl group with 2 to 8 carbon atoms, $R_2$ is a cycloalkyl group with 5 to 8 carbon atoms which is unsubstituted or substituted by one or more alkyl groups containing 1 to 4 carbon atoms, a cycloalkenyl group with 5 to 8 carbon atoms, a phenylalkyl group having 1 to 3 carbon atoms in the alkyl part and which is unsubstituted or substituted by an alkyl group with 1 to 4 carbon atoms in the benzene nucleus, an aralkenyl group containing 2 or 3 carbon atoms in the alkenyl part, or a $COOR_3$ group in which $R_3$ is phenyl, phenyl substituted by alkyl having 1 to 4 carbon atoms, aryloxyalkyl in which the alkyl part contains 2 or 3 carbon atoms and the aryl part is unsubstituted or substituted by one or more chlorine or one or more alkyl groups with 1 to 4 carbon atoms, or a phenylalkyl having 1 to 3 carbon atoms in the alkyl part and which is unsubstituted or substituted by alkyl of 1 to 4 carbon atoms in the benzene nucleus or a phenylhydroxyethyl group and with the proviso that (a) the total number of aliphatic carbon atoms in $(R_1)_{n-1+R2}$ does not exceed 8

(b) the total number of aliphatic carbon atoms in $(R_1)_{n-1}$ when $R_2$ is alicyclic or phenylalkyl is 2, and (c) when the adduct is derived from styrene oxide, $R_2$ can be hydrogen or chlorine.

2. A process as claimed in claim 1 in which the adduct is derived from condensation of an average of one mole of ethylene oxide, propylene oxide, styrene oxide or a mixture of these oxides with one mole of the compound of formula (1).

3. A process as claimed in claim 2 in which the adduct is derived from condensation of one mole of ethylene oxide with one mole of the compound of formula (1).

4. A process as claimed in claim 1 in which $R_1$ is an alkyl group containing from 1 to 4 carbon atoms.

5. A process as claimed in claim 1 in which $R_1$ is an alkoxy group containing from 1 to 4 carbon atoms.

6. A process as claimed in claim 1 in which $R_1$ is alkenyl group containing 3 or 4 carbon atoms.

7. A process as claimed in claim 1, in which the dyeing assistant used is at least one compound of the formula

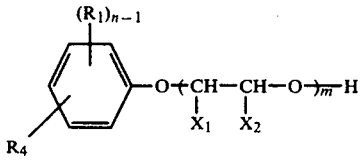

(2)

wherein $R_1$ and n have the meaning given in claim 1, $R_4$ represents a cycloalkyl group with 5 to 8 carbon atoms which is unsubstituted or substituted by one or two alkyl groups containing 1 to 4 carbon atoms, a cycloalkenyl group with 5 to 8 carbon atoms, a phenylalkyl group having 1 to 3 carbon atoms in the alkyl part and which is unsubstituted or substituted by alkyl with 1 to 4 carbon atoms in the benzene nucleus, a phenylalkenyl group having 2 or 3 carbon atoms in the alkenyl part, one of $X_1$ and $X_2$ is hydrogen, methyl or phenyl and the other X is hydrogen and m is a number from 1 to 4, with the proviso that (a) the total number of carbon atoms in $(R_1)_{n-1}$ is at most 8, and (b) when one of $X_1$ and $X_2$ represents phenyl, $R_4$ can also be hydrogen or chlorine.

8. A process as claimed in claim 7 in which $R_1$ is a straight or branched alkyl group with a total of 3 to 7 carbon atoms.

9. A process as claimed in claim 7 in which $R_1$ is hydrogen, methyl or chlorine, n is 2 and $R_4$ represents cyclopentyl, cyclohexyl, benzyl, α-methylbenzyl or α,α-dimethylbenzyl.

10. A process as claimed in claim 7 in which $R_1$ and $R_4$, independently of the other, are hydrogen or chlorine, one of $X_1$ and $X_2$ is phenyl and the other X is hydrogen, m is 1 or 2 and n is 2 to 4.

11. A process as claimed in claim 9 in which the dyeing assistant is 2-(2-isopropyl-phenoxy)ethanol.

12. A process as claimed in claim 9 in which the dyeing assistant is 2-(4-cyclohexyl-phenoxy)ethanol.

13. A process as claimed in claim 9 in which the dyeing assistant is 2-(4-chloro-2-benzyl-phenoxy)ethanol.

14. A process as claimed in claim 9 in which the dyeing assistant is 2-(2-α-methyl-benzyl-phenoxy)ethanol.

15. A process as claimed in claim 9 in which the dyeing assistant is 2-(4-α,α-dimethyl-benzyl-phenoxy)ethanol.

16. A process as claimed in claim 1 in which the dyeing assistant used is at least one compound of the formula

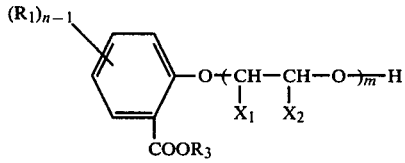

(3)

wherein $R_1$, $R_3$ and n have the meanings given in claim 1, one of $X_1$ and $X_2$ is hydrogen, methyl or phenyl and the other X is hydrogen and m is a number from 1 to 4.

17. A process as claimed in claim 16 in which $R_1$ is hydrogen, $R_3$ is phenyl or benzyl, one of $X_1$ and $X_2$ is hydrogen or methyl and the other X is hydrogen, and m is 1.

18. A process as claimed in claim 1 in which the hydrophobic fibre is polyethylene terephthalate fibre.

19. A process as claimed in claim 1 in which the amount of adduct defined in claim 1 used in the aqueous dye liquor is from 0.05% to 2% by volume, based on the total volume of the aqueous dye liquor.

20. A process as claimed in claim 19 in which the amount of adduct used in the aqueous dye liquor is from 0.1% to 1% by volume based on the total volume of the aqueous dye liquor.

21. A process as claimed in claim 1 in which the adduct defined in claim 1 is mixed with an emulsifying agent.

22. A process as claimed in claim 21 in which the emulsifying agent is a sulphated alkylphenol ethylene oxide adduct.

23. A process as claimed in claim 21 in which the emulsifying agent is a sulphited fish oil.

24. A polyester fibre dyed by a process as claimed in claim 1.

* * * * *